US012042005B2

(12) United States Patent
Mariacher

(10) Patent No.: US 12,042,005 B2
(45) Date of Patent: Jul. 23, 2024

(54) CLIMBING SHOE

(71) Applicant: CALZATURIFICIO S.C.A.R.P.A. S.P.A., Asolo (IT)

(72) Inventor: Heinrich Mariacher, Asolo (IT)

(73) Assignee: CALZATURIFICIO S.C.A.R.P.A. S.P.A. (IT)

( * ) Notice: Subject to any disclaimer, the term of this patent is extended or adjusted under 35 U.S.C. 154(b) by 9 days.

(21) Appl. No.: 17/734,823

(22) Filed: May 2, 2022

(65) Prior Publication Data

US 2022/0346493 A1 Nov. 3, 2022

(30) Foreign Application Priority Data

May 3, 2021 (IT) ..... 102021000011219

(51) Int. Cl.
*A43B 13/14* (2006.01)
*A43B 5/00* (2022.01)
*A43B 13/04* (2006.01)

(52) U.S. Cl.
CPC ..... *A43B 13/141* (2013.01); *A43B 5/003* (2013.01); *A43B 13/04* (2013.01)

(58) Field of Classification Search
CPC ..... A43B 5/003; A43B 5/12
See application file for complete search history.

(56) References Cited

U.S. PATENT DOCUMENTS

2003/0221337 A1* 12/2003 Farys ..... A43B 5/003 36/113

FOREIGN PATENT DOCUMENTS

| | | | | |
|---|---|---|---|---|
| EP | 0933033 A2 | | 8/1999 | |
| EP | 2274994 A1 | | 1/2011 | |
| EP | 2274994 B1 | * | 6/2014 | ..... A43B 11/00 |
| EP | 3571948 A1 | | 11/2019 | |
| EP | 3811809 A1 | | 4/2021 | |

* cited by examiner

*Primary Examiner* — Sharon M Prange
*Assistant Examiner* — Grady Alexander Nunnery
(74) *Attorney, Agent, or Firm* — The Belles Group, P.C.

(57) ABSTRACT

Climbing shoe comprising: a shoe-upper which is shaped to accommodate and substantially cover the entire foot of the user; a sole made of polymeric material, which is fixed to the bottom of the shoe-upper so as to cover at least the front part of the bottom of said shoe-upper; and a shoe-upper elastic tensioning system, which tightens the shoe-upper on the foot of the user; the ogival front part of the shoe-upper being provided with a tip (6) and, respectively, with an outer front side and an inner front side that are arranged on opposite sides of the tip so as to flank the forefoot of the user on both sides; the elastic tensioning system comprising a plantar tensioning band, which is made of elastomeric material, is firmly fixed to the bottom of the shoe-upper underneath the sole, and is shaped so as to connect the tip and the outer and inner front sides of the shoe-upper directly to a saddle-shaped patch, separate and distinct from said plantar tensioning band, which is made of soft and flexible material and is placed on the rear part of the shoe-upper, in the area over the calcaneus of the user's foot.

11 Claims, 3 Drawing Sheets

CLIMBING SHOE

CROSS-REFERENCE TO RELATED APPLICATIONS

This patent application claims priority from Italian patent application no. 102021000011219 filed on May 3, 2021, the entire disclosure of which is incorporated herein by reference.

TECHNICAL FIELD OF THE INVENTION

The present invention relates to a climbing shoe.

STATE OF THE ART

As is known, the currently most widespread climbing shoes comprise: a shoe-upper made of leather and/or tissue which is shaped substantially like a sock so as to accommodate and cover the user's foot, including the sole of the foot; a front tensioning band with ribbon-like structure, which is made of a high-elasticity elastomeric material, is substantially U-bent, and is firmly fixed to the front part of the shoe-upper by gluing so as to cover the tip and the inner and outer sides of the front part of the shoe-upper; a rear tensioning band with ribbon-like structure, which is made of a high-elasticity elastomeric material, is substantially U-bent, and is fixed by gluing on the rear part of the shoe-upper so as to cover the area over the heel, and then extend obliquely along the two lateral sides of the shoe-upper up to reach and join the front tensioning band; and a lower sole which is made of soft and flexible polymeric material with a high friction coefficient and substantially inextensible, and is fixed by gluing to the bottom of the shoe-upper locally overlapping the front and rear tensioning bands, so as to cover the entire sole of the user's foot.

In Patent application EP0933033 A2, on the other hand, there is disclosed a climbing shoe wherein the rear tensioning band is made in one piece with a midsole which is fixed by gluing on the phalangeal section of the bottom of the shoe-upper, underneath the sole, and is shaped so as to extend obliquely along a first lateral side of the shoe-upper up to reach the area over the calcaneus of the user's foot, and then to descend obliquely along the other lateral side of the shoe-upper up to reach and join by gluing again the midsole, substantially at the metatarsal section of the bottom of the shoe-upper.

The front tensioning band, in turn, is replaced by an oblong-shaped patch that is made of elastomeric material and is fixed to the shoe-upper so as to cover and protect only the tip of the shoe-upper and then rise along the upper part of the shoe-upper in a nearly sagittal direction, leaving the inner and outer sides of the front part of the shoe-upper uncovered.

In other words, the patch only covers and protects the central area/sector of the upper-front part of the shoe-upper. In some points of the climbing shoe, the user's toes are therefore covered only by the sock-like shoe-upper.

Unfortunately, despite simplifying the structure of the climbing shoe with the consequent savings in production, the climbing shoe disclosed in Patent application EP0933033 A2 does not adequately protect the user's toes from impacts, and furthermore does not offer adequate forefoot restraining capacity during climbing, with the operating limits that this entails.

SUBJECT AND SUMMARY OF THE INVENTION

Aim of the present invention is to make a climbing shoe which is capable of overcoming the disadvantages described above, and which is in any case simpler and cheaper to manufacture than traditional climbing shoes with a front tensioning band and a rear tensioning band.

In accordance with these aims, according to the present invention there is provided a climbing shoe as defined in claim 1 and preferably, though not necessarily, in any one of the Claims depending on it.

BRIEF DESCRIPTION OF THE DRAWINGS

The present invention will now be described with reference to the attached drawings, which illustrate a nonlimiting embodiment thereof, wherein:

FIG. 5 is a plan view of the tensioning band of the climbing shoe shown in the previous figures; whereas

DETAILED DESCRIPTION OF PREFERRED EMBODIMENTS OF THE INVENTION

Figure 1:
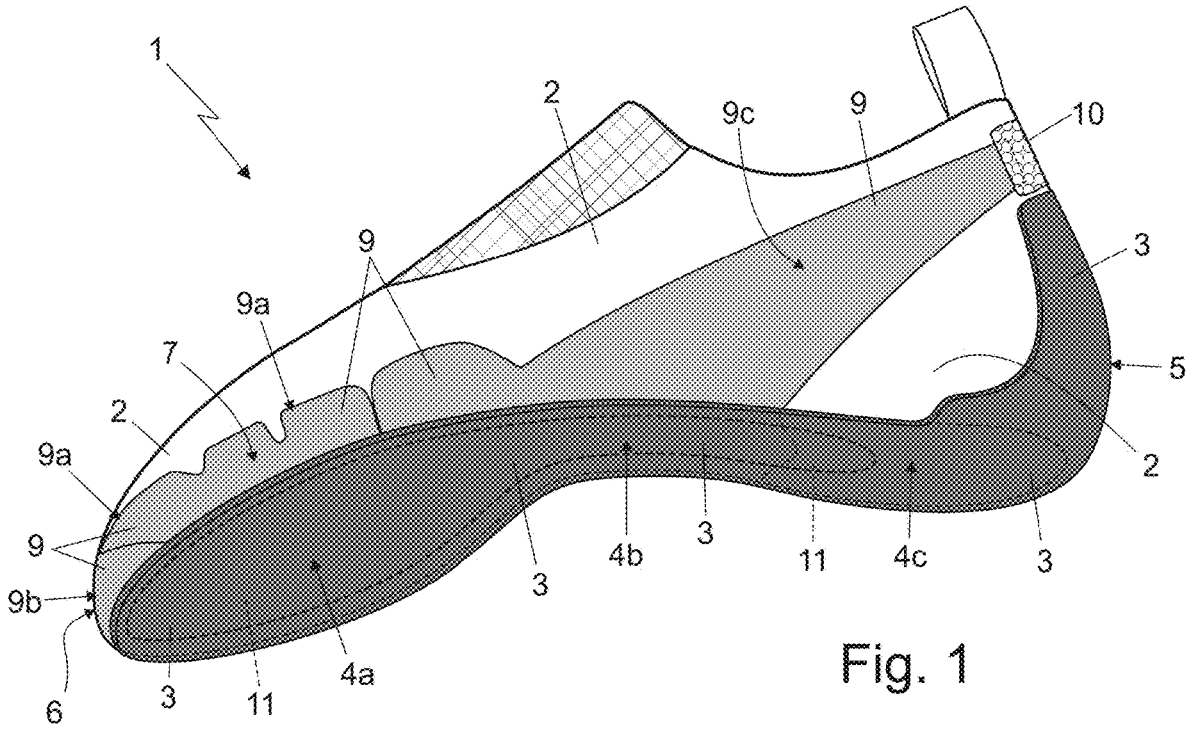
FIGS. 1 and 2 are two perspective and schematic views of a climbing shoe realized according to the teachings of the present invention.

With reference to FIGS. 1, 2, 3 and 4, reference number 1 denotes as a whole a climbing shoe which may be particularly advantageously used for climbing indoor walls classified as grade IV or lower.

The climbing shoe 1 firstly comprises: a shoe-upper 2 preferably made of leather and/or tissue, which is substantially sock-shaped so as to accommodate and completely cover the user's foot, including the sole of the foot; and a plate-like sole 3 which is made of a soft and flexible polymeric material with a high friction coefficient and preferably also inextensible, and is firmly fixed to the bottom 4 of shoe-upper 2 preferably by gluing, so as to cover at least the front part of the bottom 4 of shoe-upper 2.

In more detail, the front part of the shoe-upper 2 is intended to accommodate the user's forefoot. The rear part of the shoe-upper 2, in turn, is shaped so as to cover and protect the calcaneus of the user's foot.

The bottom 4 of the shoe-upper 2, i.e. the piece of the shoe-upper 2 covering the sole of the user's foot, on the other hand is longitudinally divided into a front or tarsus-phalangeal section 4*a* located immediately underneath the phalangeal region of the sole of the user's foot; a central or metatarsal section 4*b* located immediately underneath the metatarsal region of the sole of the user's foot, i.e. underneath the plantar arch; and a rear or talus-calcaneal section 4*c* located immediately underneath the talus-calcaneal region of the sole of the user's foot.

The sole 3 is preferably oblong in shape and is preferably shaped/dimensioned so as to substantially cover the entire bottom 4 of shoe-upper 2, i.e. the front or phalangeal section 4*a*, the central or metatarsal section 4*b* and finally the rear or talus-calcaneal section 4*c* of the bottom 4.

In other words, the sole 3 is preferably shaped/dimensioned so as to cover, without interruptions, the entire sole of the user's foot.

In addition, the rear part of sole 3 is preferably also substantially L-bent so as to rise along the rear part 5 of the shoe-upper 2 preferably while remaining astride of the footwear midplane, so as to cover and protect the sole and the calcaneus of the user's foot.

Preferably the sole 3 is moreover made of a polymeric material having a hardness (UNI 4916) preferably lower than 80 ShoreA and optionally ranging between 50 and 75 ShoreA.

In more detail, in the example shown the front sole 3 is preferably made of a soft and flexible polymeric material, such as for example the XS Edge compound or the GRIP 2 compound manufactured by the Italian company VIBRAM S.P.A.

With reference to FIGS. 1 to 5, the climbing shoe 1 additionally comprises a elastic tensioning system of the shoe-upper, which is firmly fixed to the shoe-upper 2, outside thereof, and is adapted to elastically tighten the shoe-upper 2 on the user's foot.

More in detail, the front part of shoe-upper 2 is substantially ogival in shape and is provided with a tip 6 and, respectively, with an outer front side 7 and with an inner front side 8, which are arranged on opposite sides of the tip 6 so as to flank the user's forefoot on both sides.

The elastic tensioning system of the shoe-upper basically comprises a plantar tensioning band 9 with elastic and monolithic structure, which is made of elastomeric material, is firmly fixed to the bottom 4 of the shoe-upper 2 preferably by gluing, and is shaped so as to connect the ogival tip 6 and the front outer 7 and inner 8 sides of the shoe-upper 2 directly to the rear part 5 of the shoe-upper 2, passing underneath the sole 3.

In more detail, the plantar tensioning band 9 is made of a high-elasticity elastomeric material, and is preferably firmly fixed on the outer surface of the shoe-upper 2 preferably by gluing.

The plantar tensioning band 9, in addition, is structured so as to simultaneously connect the tip 6, the outer front side 7 and the inner front side 8 of the shoe-upper 2 directly to the area of the shoe-upper 2 that is immediately above the calcaneus of the user's foot.

Preferably, the plantar tensioning band 9 is moreover provided with an elastic modulus (Young's modulus) significantly lower than that of the sole 3.

More in detail, the plantar tensioning band 9 is preferably provided with an elastic modulus 2-10 times lower than that of the sole 3.

In addition, the elastomeric material forming the plantar tensioning band 9 preferably has a hardness (UNI 4916) higher than that of the polymeric material forming the sole 3.

With reference to FIGS. 1 to 5, in particular the plantar tensioning band 9 is longitudinally divided into a front portion and a rear portion.

The front portion of the plantar tensioning band 9 is preferably dimensioned so as to entirely cover the front or phalangeal section 4*a* of the bottom 4, at least partially the adjacent central or metatarsal section 4*b* of the bottom 4, and optionally also a part of the rear or talus-calcaneal section 4*c*.

In addition, the front portion of the plantar tensioning band 9 is shaped/dimensioned so as to also extend along the upper-front area of the shoe-upper 2 to cover, preferably without interruption, also the tip 6 and the sides 7 and 8 of the front ogival part of shoe-upper 2.

More in detail, the front portion of the plantar tensioning band 9 is preferably provided with a pair of protruding front flaps 9*a* and 9*b*, that are bent upwards so as to cover, respectively, the outer front side 7 and the inner front side 8 of shoe-upper 2, preferably overlapping one to the other at the tip 6.

In other words, the protruding flap 9*a* of tensioning band 9 is preferably shaped/dimensioned so as to cover, without interruptions, the tip 6 and the outer front side 7 of shoe-upper 2.

The protruding flap 9*b* of tensioning band 9, in turn, is preferably shaped/dimensioned so as to cover, without interruptions, the tip 6 and the inner front side 8 of shoe-upper 2.

At the tip 6 of the shoe-upper, the protruding flap 9*b* of plantar tensioning band 9 preferably surmounts the protruding flap 9*a*.

In other words, the protruding flap 9*a* is preferably fixed directly to the outer surface of the shoe-upper 2 preferably by gluing. The protruding flap 9*b* of the plantar tensioning band 9, in turn, is preferably fixed directly to the outer surface of the shoe-upper 2 and to the protruding flap 9*a* of the same band preferably by gluing.

With reference to FIGS. 1 to 5, the rear portion of the plantar tensioning band 9, on the other hand, has a forked structure and basically consists of two oblong and ribbon-like appendages 9*c* and 9*d*, which branch off/depart from the front portion of the plantar tensioning band 9 substantially at the central or metatarsal section 4*b* of the bottom 4 of shoe-upper 2, and extend obliquely along the outer and inner lateral sides of shoe-upper 2, on opposite sides of the footwear midplane, towards the area of the shoe-upper 2 immediately above the calcaneus of the user's foot.

More in detail, the elastic tensioning system of the shoe-upper also includes a small saddle-shaped patch 10, separate and distinct from the plantar tensioning band 9 and the sole 3, which is made of a soft and flexible material and is firmly placed/fixed to the rear part 5 of shoe-upper 2, in the area immediately above the user's calcaneus.

Preferably the saddle-shaped patch 10 moreover has a substantially inextensible structure.

More in detail, the saddle-shaped patch 10 has an elastic modulus (Young's modulus) higher than that of the plantar tensioning band 9.

Preferably the saddle-shaped patch 10 furthermore has a surface hardness (UNI 4916) lower than that of the plantar tensioning band 9.

The ribbon-like and oblong, protruding appendages 9*c* and 9*d* of plantar tensioning band 9 extend along the lateral sides of the shoe-upper 2, up to firmly reach and join the saddle-shaped patch 10, on opposite sides of the saddle-shaped patch 10 and of the footwear midplane, and are preferably firmly fixed to the outer surface of the shoe-upper 2 without interruption, preferably by gluing.

The distal ends of the ribbon-like appendages 9*c* and 9*d* of the plantar tensioning band 9 are therefore arranged on opposite sides of the footwear midplane, spaced apart from each other.

Preferably, the ribbon-like appendages 9*c* and 9*d* of the tensioning band 9 are moreover pre-tensioned.

The saddle-shaped patch 10 is adapted to distribute the pressure/force exerted by the ribbon-like appendages 9*c* and 9*d* of tensioning band 9 over a wider area of the foot.

Figure 2:
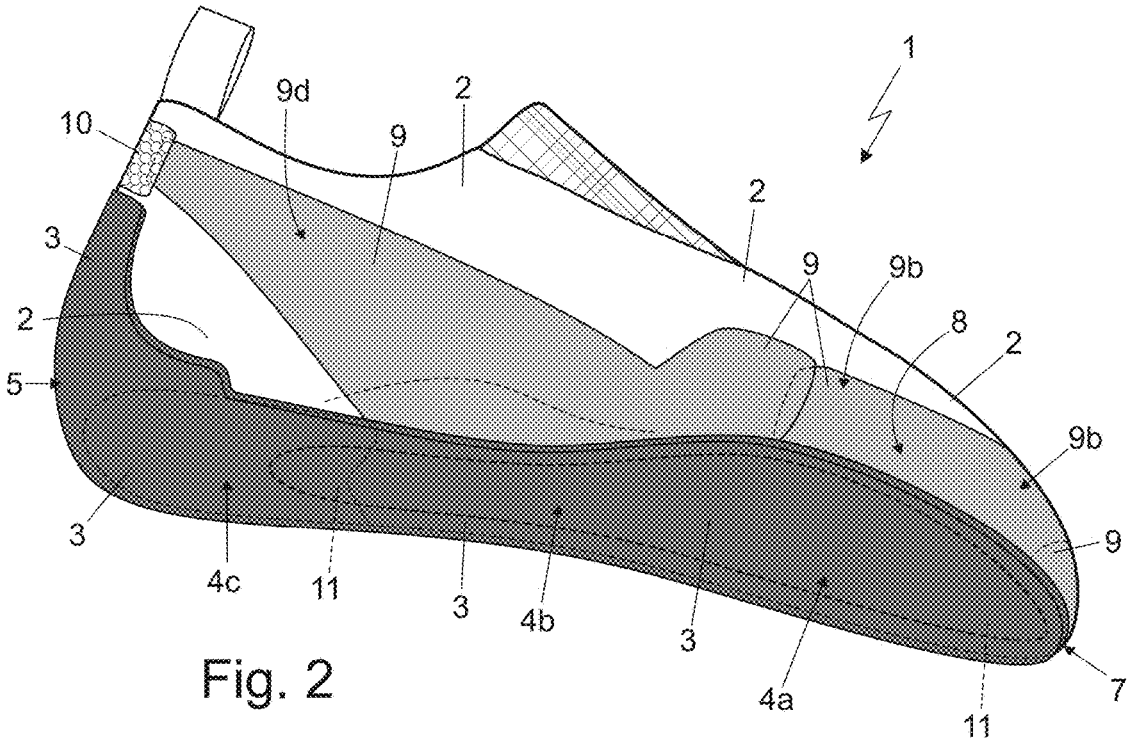
Figure 3:
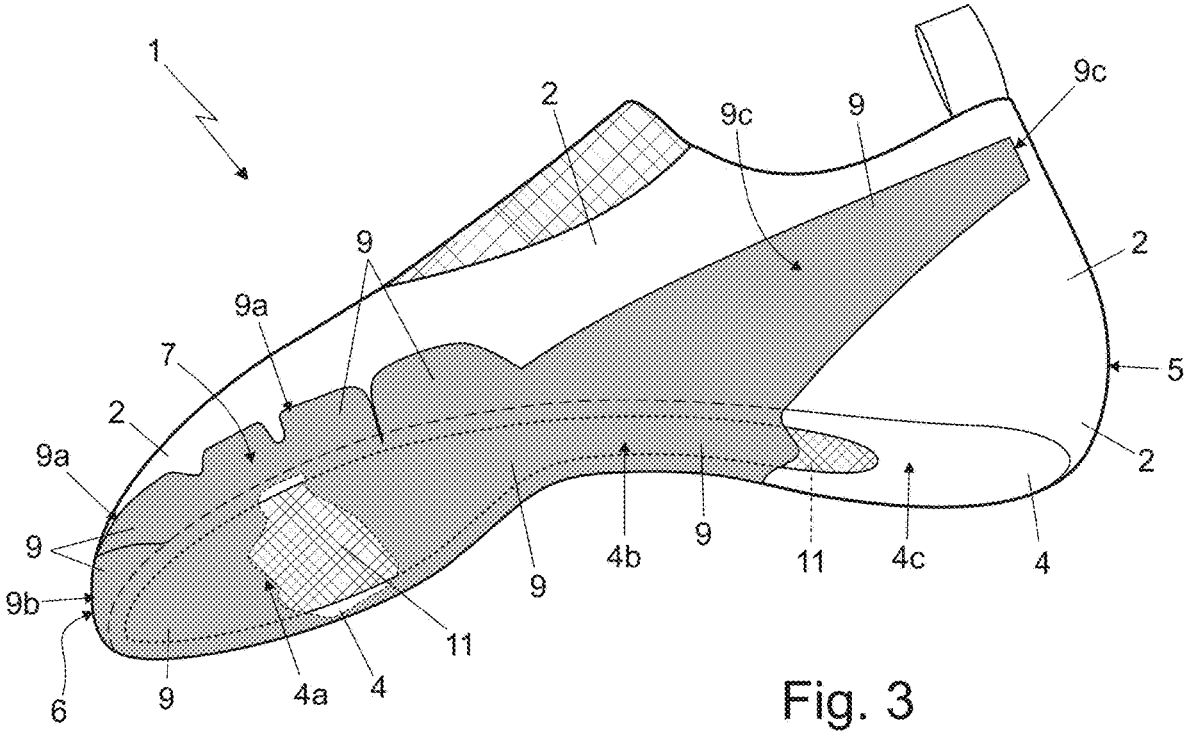
FIG. 3 is a perspective view of the climbing shoe shown in FIGS. 1 and 2, with parts removed for clarity's sake.
Figure 4:
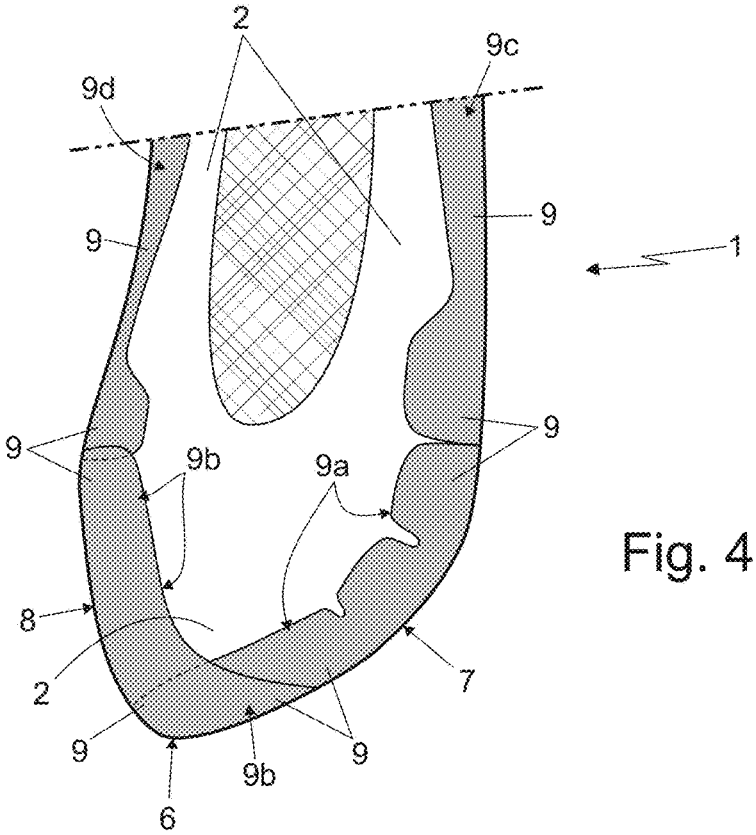
FIG. 4 is a view of the upper-front part of the climbing shoe shown in the previous Figures.
Figure 5:
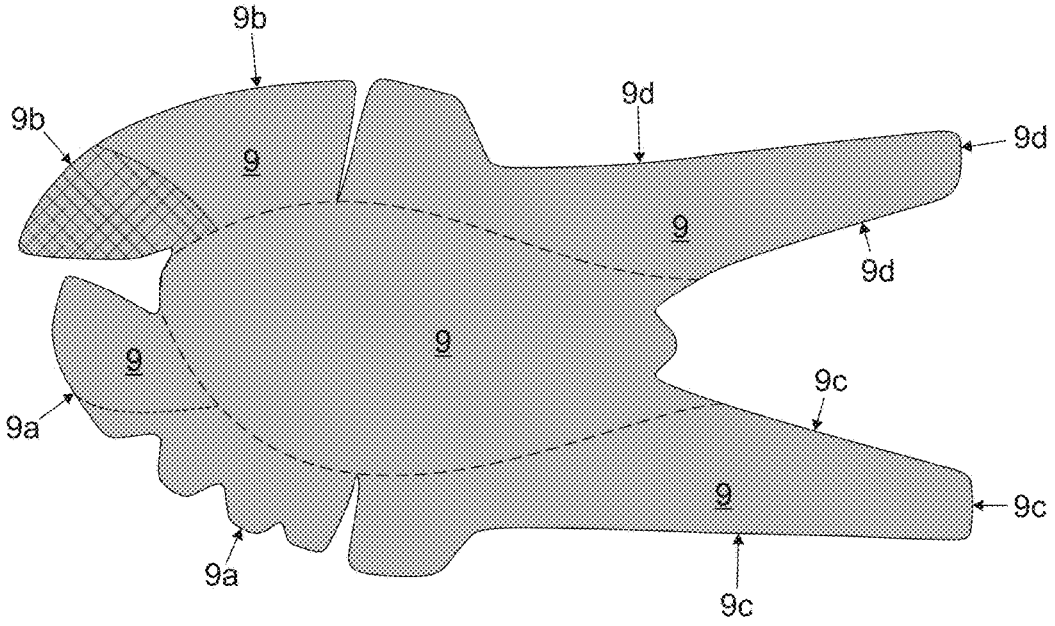

With reference to FIGS. 1, 2 and 3, therefore, the ribbon-like appendage 9*c* of the plantar tensioning band 9 extends obliquely along the outer lateral side of the shoe-upper 2, and is adapted to connect the tip 6 and the front sides 7 and 8 of the shoe-upper 2 directly to the saddle-shaped patch 10.

The ribbon-like appendage 9*d* of the plantar tensioning band 9, on the other hand, extends obliquely on the inner lateral side of shoe-upper 2, and is adapted to connect the tip 6 and the front sides 7 and 8 of the shoe-upper 2 directly to the saddle-shaped patch 10, obviously on the opposite side with respect to the ribbon-like appendage 9*c*.

Preferably the plantar tensioning band 9 is finally made of an elastomeric material having a hardness (UNI 4916) greater than or equal to 80 ShoreA.

With reference to FIGS. 1 and 2, the saddle-shaped patch 10, in turn, is preferably made of a polymeric sheet material, and preferably has a substantially inextensible structure.

Preferably, the saddle-shaped patch 10 is moreover firmly fixed to the shoe-upper 2 and/or to the distal ends of the ribbon-like appendages 9*c* and 9*d* of plantar tensioning band 9 preferably by gluing.

In addition, the saddle-shaped patch 10 surmounts the distal ends of the ribbon-like appendages 9*c* and 9*d* of the plantar tensioning band 9.

With reference to FIGS. 1, 2 and 3, preferably the climbing shoe 1 finally also comprises an oblong and plate-like, semi-rigid insert 11 that is firmly fixed to the bottom 4 of the shoe-upper 2, beneath the sole 3 and the plantar tensioning band 9, so as to locally stiffen at least the front part of the bottom 4.

Moreover, in the mutual overlapping points, the plantar tensioning band 9 surmounts the semi-rigid plate-like insert 11.

In addition, the semi-rigid plate-like insert 11 is preferably arranged on the bottom 4 of shoe-upper 2 astride the centreline of the bottom, and is preferably firmly fixed to the outer surface of the shoe-upper 2 by gluing.

More specifically, the semi-rigid plate-like insert 11 preferably extends astride the centerline of the bottom 4, along the front or phalangeal section 4*a*, the middle or metatarsal section 4*b*, and part of the rear or talus-calcaneal section 4*c* of the bottom 4. Preferably, the semi-rigid plate-like insert 11 furthermore consists of a flat sheet made of plastic or composite material with a thickness ranging 0.3 and 3 mm (millimetres), which is substantially rigid and non-deformable for mechanical stresses directed parallel to the lying plane of the sheet, and flexible for stresses orthogonal to the lying plane of the sheet.

In the example shown, in particular, the semi-rigid plate-like insert 11 preferably consists of a sheet of composite material having a multilayer structure, which is formed by a sheet of preferably polyurethane- or vinyl-based, thermoplastic material and by a piece of fabric stably coupled to one of the two faces of the sheet of thermoplastic material by gluing.

Operation of the climbing shoe 1 is easily inferable from the above.

Due to the special shape of the front portion of the plantar tensioning band 9, the climbing shoe 1 causes a very pronounced curvature of the user's forefoot.

In addition, the protruding flaps 9*a* and 9*b* of the plantar tensioning band 9 further bend downwards the ends of the user's toes, thus forcing the forefoot to overall assume an inverted-spoon shape.

Moreover, the ribbon-like appendages 9*c* and 9*d* of the plantar tensioning band 9 may be fixed to the shoe-upper 2 with a different degree of pre-tensioning, and thus allow the climbing shoe 1 to bring into tension the inner and outer sides of the user's foot in a differentiated and asymmetric manner.

The advantages connected to the particular shape and arrangement of the plantar tensioning band 9 are remarkable.

Being provided with a single tensioning band acting on both the front part and the rear part of the user's foot, the climbing shoe 1 is simpler and cheaper to manufacture, while still ensuring a high restraining capacity of the user's foot.

In addition, as the two protruding flaps 9*a* and 9*b* overlap each other at the tip 6, the climbing shoe 1 offers the user's big toe a better support and a greater impact protection when climbing.

It is finally clear that variations and modifications may be made to the climbing shoe 1 without however departing from the scope of the present invention.

For example, the saddle-shaped patch 10 may be also made of leather.

Figure 6:
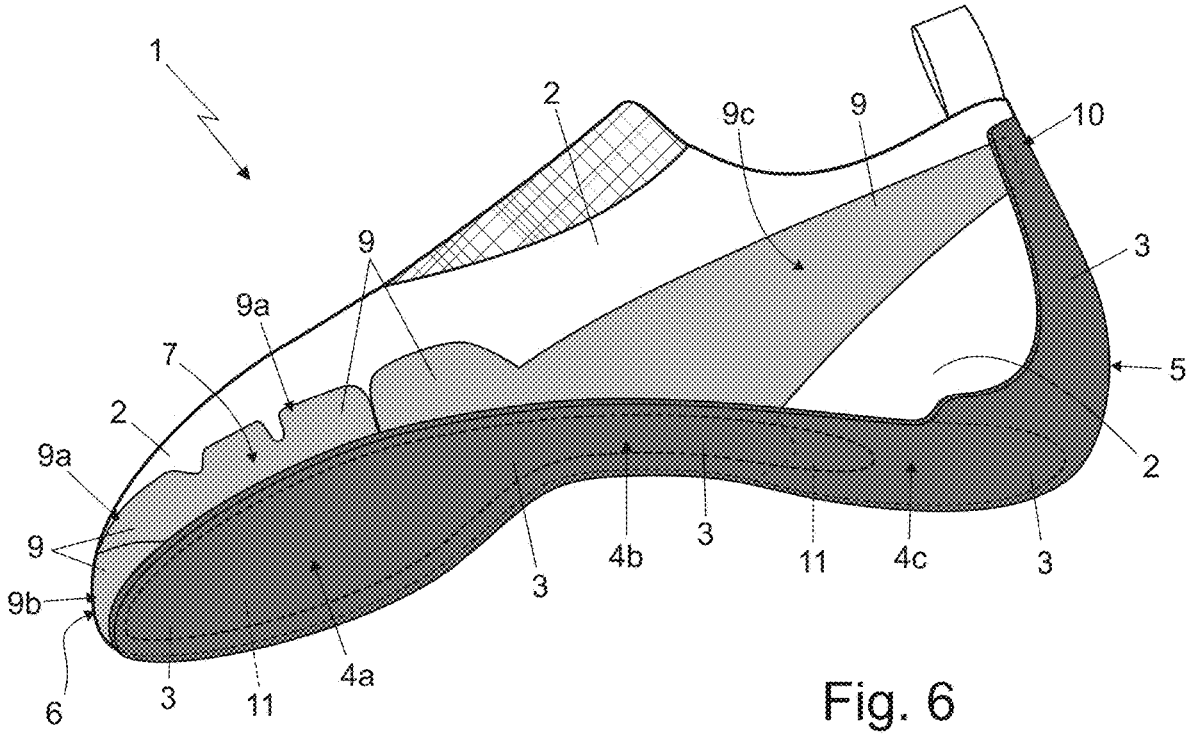
FIG. 6 is a perspective and schematic view of an embodiment variation of the climbing shoe shown in the previous Figures.

In addition, with reference to FIG. 6, in a less sophisticated embodiment, the saddle-shaped patch 10 is incorporated into the rear end of the sole 3.

In other words, in this embodiment variation, the sole 3 rises along the rear part 5 of shoe-upper 2, preferably while remaining astride the footwear midplane, up to reach the area of the shoe-upper 2 immediately above the calcaneus of the user's foot.

The oblong and ribbon-like, protruding appendages 9*c* and 9*d* of the plantar tensioning band 9, in turn, extend along the inner and outer sides of the shoe-upper 2, up to reach and join firmly to the rear end of the sole 3, on opposite sides of the end of the sole 3 and od the footwear midplane.

The invention claimed is:

1. A climbing shoe comprising: a shoe-upper which is shaped so as to accommodate and cover substantially an entire user's foot and is provided with an ogival front part adapted to accommodate a forefoot of the user's foot; a sole made of polymeric material, which is fixed to a bottom of the shoe-upper so as to cover at least a front part of the bottom of said shoe-upper; and a shoe-upper elastic tensioning system which is adapted to tighten the shoe-upper on the user's foot;

wherein the ogival front part of the shoe-upper is provided with a tip and with an outer front side and an inner front side that are arranged on opposite sides of the tip;

wherein the elastic tensioning system comprises a one-piece plantar tensioning band which is made of elastomeric material, is firmly fixed to the bottom of the shoe-upper underneath the sole, and is shaped so as to connect the tip and the outer and inner front sides of the shoe-upper directly to a saddle-shaped patch, separated and distinct from said one-piece plantar tensioning band, which is made of a soft and flexible material and is placed on a rear part of the shoe-upper that is configured to be over a calcaneus of the user's foot;

wherein a front portion of said one-piece plantar tensioning band has a pair of protruding front flaps which are bent upwards so as to and cover, respectively, the outer front side and the inner front side of the shoe-upper, and which overlap to one another at the tip of the shoe-upper; and wherein a rear portion of said one-piece plantar tensioning band has a forked structure that comprises a pair of oblong and ribbon like appendages that extend obliquely along opposite lateral sides of the shoe-upper and end at said saddle-shaped patch.

2. The climbing shoe according to claim 1, wherein the one-piece plantar tensioning band is provided with a front portion that covers the phalangeal section of the bottom of the shoe-upper; said front portion of the one-piece plantar tensioning band being shaped and/or dimensioned so as to also extend along an upper-front area of the shoe-upper to cover both the tip and the outer and inner front sides of the shoe-upper.

3. The climbing shoe according to claim 1, wherein the protruding front flap of said pair of protruding front flaps that covers the inner front side of the shoe-upper surmounts the protruding front flap of said pair of protruding front flaps that covers the outer front side of the shoe-upper.

4. The climbing shoe according to claim 2, wherein the front portion of said one-piece plantar tensioning band is dimensioned so as to cover substantially an entire phalangeal section of the bottom of the shoe-upper, and at least partially an adjacent metatarsal section of the bottom.

5. The climbing shoe according to claim 1, wherein the oblong appendages of the rear portion of said one-piece plantar tensioning band branch off from the front portion of said one-piece plantar tensioning band substantially at a metatarsal section of the bottom of the shoe-upper.

6. The climbing shoe according to claim 1, wherein the sole is oblong in shape and covers substantially an entire bottom of the shoe-upper.

7. The climbing shoe according to claim 4, wherein the rear part of the sole is substantially L-bent and rising along a rear part of the shoe-upper, to cover and protect the calcaneus of the user's foot.

8. The climbing shoe according to claim 5, wherein the saddle-shaped patch is incorporated in a rear end of the sole.

9. The climbing shoe according to claim 1, wherein the saddle-shaped patch is separated and distinct from the sole.

10. The climbing shoe according to claim 1, wherein the saddle-shaped patch has a substantially inextensible structure.

11. The climbing shoe according to claim 1, characterised by additionally comprising an oblong semi-rigid insert which is interposed between the bottom of the shoe-upper and the one-piece plantar tensioning band, so as to stiffen at least the front part of said bottom.

* * * * *